US006196793B1

(12) United States Patent
Braaten

(10) Patent No.: US 6,196,793 B1
(45) Date of Patent: Mar. 6, 2001

(54) NOZZLE BOX

(75) Inventor: Mark Edward Braaten, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/227,866

(22) Filed: Jan. 11, 1999

(51) Int. Cl.[7] ..... F01D 9/00

(52) U.S. Cl. ..... 415/191; 415/202; 415/208.2; 415/209.2; 415/209.3

(58) Field of Search ..... 415/202, 191, 415/208.2, 209.1, 209.3, 193

(56) References Cited

U.S. PATENT DOCUMENTS

| | | | | |
|---|---|---|---|---|
| 3,804,335 | * | 4/1974 | Sohre | 239/289 |
| 5,259,727 | * | 11/1993 | Quinn | 415/190 |
| 5,392,513 | | 2/1995 | Mazzola | 29/889.1 |
| 5,927,943 | * | 7/1999 | Maier | 415/167 |

FOREIGN PATENT DOCUMENTS 61-053403 * 3/1986 (JP) .
61-129409 * 6/1986 (JP) .
61-132704 * 6/1986 (JP) .

* cited by examiner

*Primary Examiner*—Edward K. Look
*Assistant Examiner*—Ninh Nguyen
(74) *Attorney, Agent, or Firm*—Patrick K. Patnode; Marvin Snyder

(57) ABSTRACT

Apparatus and method for directing a flow of fluid to a turbine via a nozzle box mountable to encircle a shaft. The nozzle box includes a housing having an inner wall spaced from an outer wall and joined therewith so as to form a chamber therein. The housing also includes at least one inlet and at least one outlet in which each is in fluid flow communication with the chamber. A plurality of radially projecting nozzles are positioned between the inner and outer walls and located upstream of the outlet for directing the flow of fluid through the outlet. A flow distributor is positioned between the inner and outer walls and located upstream of the nozzles for directing the flow of fluid through the chamber and to the nozzles. The flow distributor is configured to obtain a substantially uniform flow of fluid to the nozzles.

13 Claims, 12 Drawing Sheets

NOZZLE BOX

BACKGROUND OF THE INVENTION

This invention relates generally to turbines, and more specifically, to a nozzle box for increasing the efficiency of a flow directed to a turbine.

By way of a more detailed background, and with reference to FIG. 1, a control or first stage 10 of a conventional turbine includes a nozzle box 12 surrounding a rotor 14, the turbine control stage represented by a single bucket 16. Nozzle box 12 generally includes a torus portion 18, a bridge ring assembly 20 and a partition ring assembly 22. In turbines of this type, steam is fed into torus portion 18 of nozzle box 12, and is directed axially between outer bridge ring 24 and inner bridge ring 26, and between a plurality of circumferentially spaced bridge elements 28, which bridge elements 28 connect rings 24 and 26. The steam then flows through partition ring assembly 22 towards bucket(s) 16. Partition ring assembly typically comprises of radially inner and outer bands 30 and 32 (each formed in 180° segments which, when the turbine is fully assembled, form 360° rings), respectively, which hold between them a large number (for example, 100) of vane-shaped partition elements 34, which partition elements 34 serve to direct the steam at a desired angle to the bucket blades. Steampath assembly 22 is welded in place between upper and lower rings 24, 26 by circumferentially extending welds 36, 38. Rings 24, 26 are, in turn, welded to torus 18 by means of circumferential welds 40, 42. Nozzle box 12 is supported within a turbine inner shell 44 by a plurality of lugs 46 (one shown) welded to the outside of torus 18 and bridge ring assembly 20, in an area radially adjacent partition ring assembly 22. Nozzle box 12 is also keyed to inner shell 44 at 48.

Within conventional nozzle box designs, however, there exists significant circumferential variation in the cylindrical flow angle and a hub-strong velocity profile of the flow entering the first stage nozzle. This type of inlet distortion can lead to a significant loss in first stage efficiency.

Accordingly, there is a need in the art for an improved nozzle box.

SUMMARY OF THE INVENTION

An apparatus and method for directing a flow of fluid to a turbine via a nozzle box mountable to encircle a shaft is disclosed. The nozzle box includes a housing having an inner wall spaced from an outer wall and joined therewith so as to form a chamber. The housing also includes at least one inlet and at least one outlet, each in fluid flow communication with the chamber. A plurality of radially projecting nozzles are positioned between the inner and outer walls and located upstream of the outlet for directing the flow of fluid through the outlet. A flow distributor is positioned between the inner and outer walls and located upstream of the nozzles for directing the flow of fluid through the chamber and to the nozzles. The flow distributor is configured to maintain a substantially uniform flow of the fluid to the nozzles.

DETAILED DESCRIPTION OF THE PREFERRED EMBODIMENT

Figure 1:
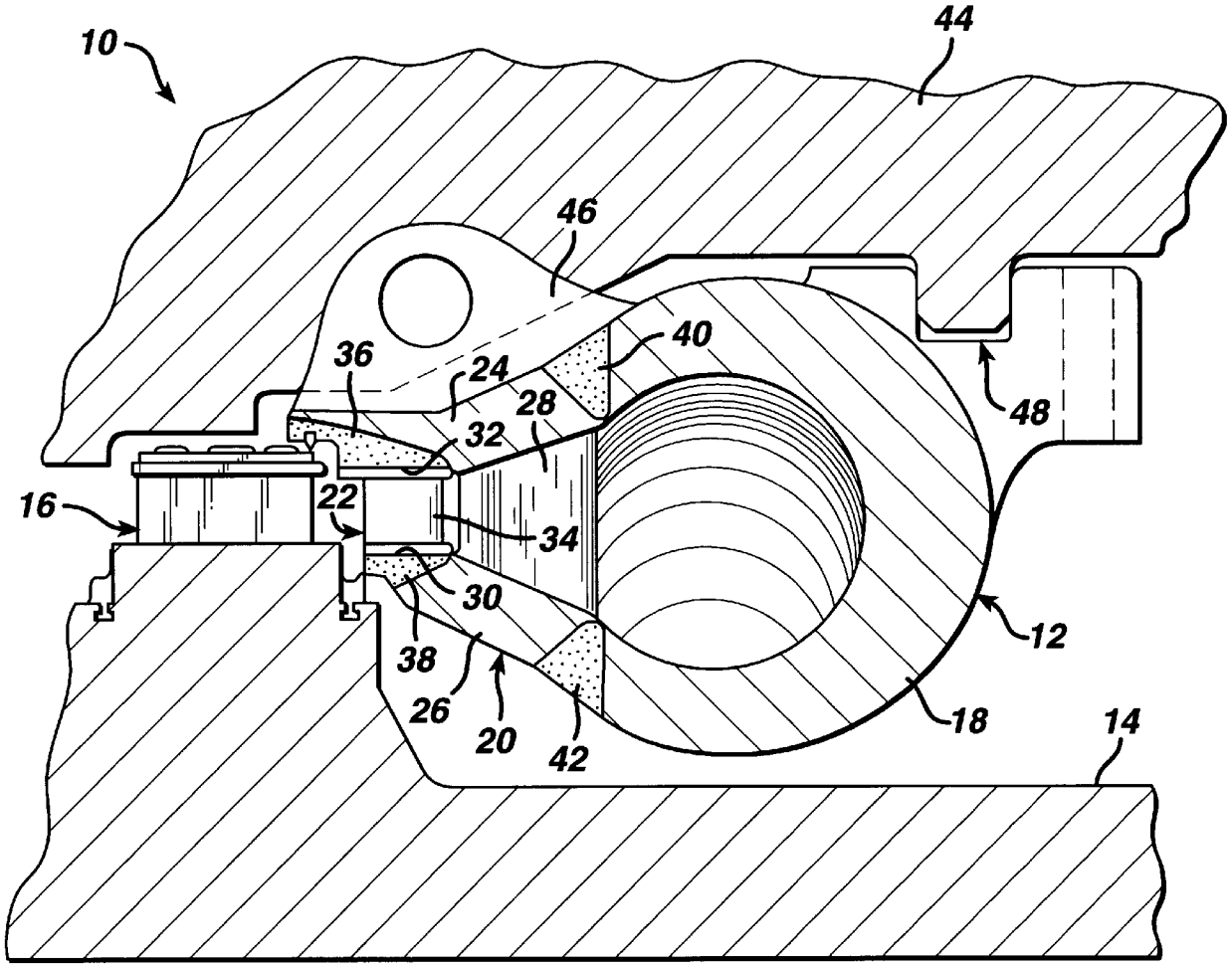
FIG. 1 PRIOR ART
FIG. 1 is a partial cross-sectional, cutaway view of a conventional nozzle box construction.
Figure 2:
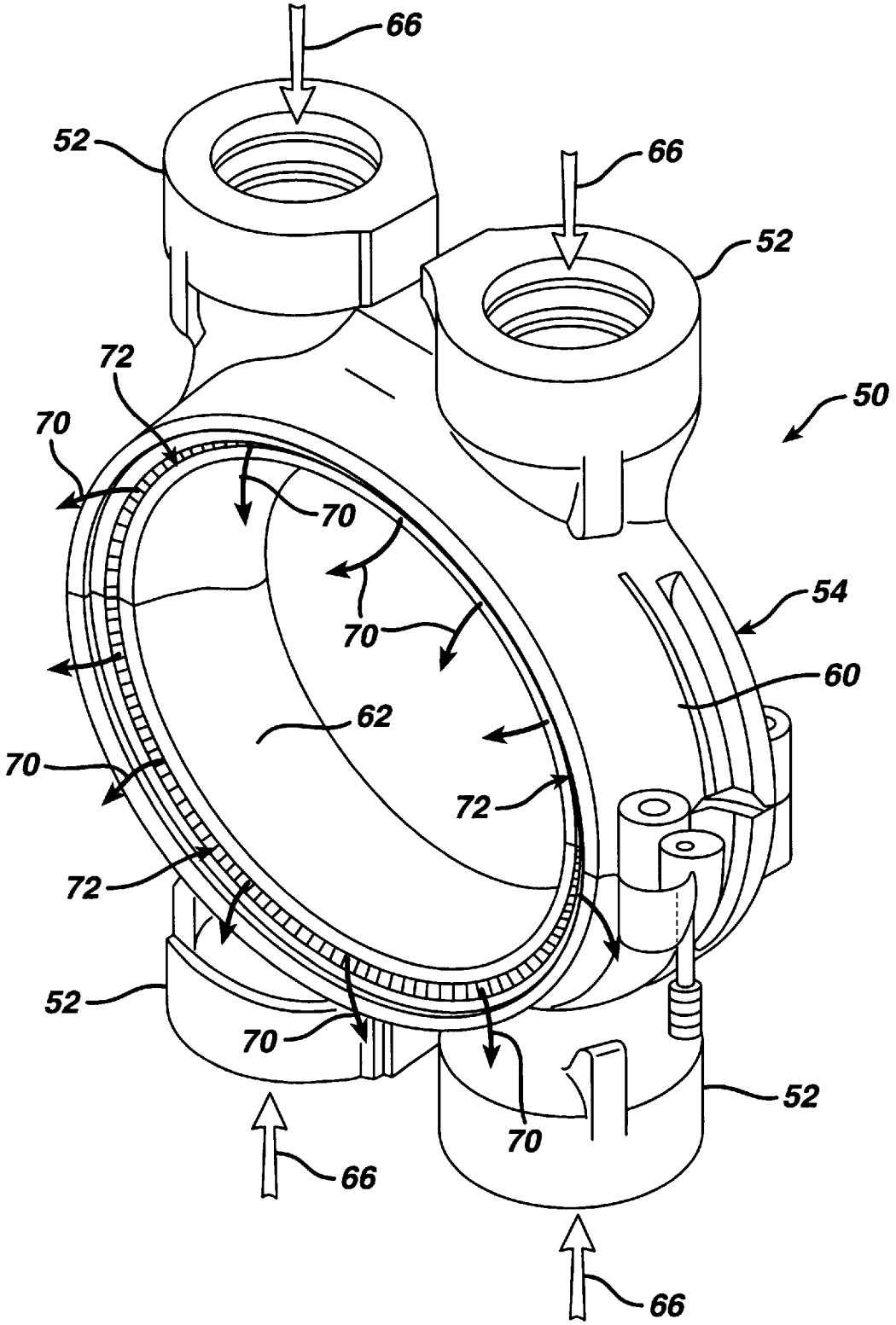
FIG. 2 is an enlarged perspective view of a conventional available nozzle box.

Referring to FIG. 2, a nozzle box 50 includes inlet pipes 52 and a torus 54. Also referring to FIG. 3, within torus 54 are typically a ring of structural bridges 56 and a ring of nozzles or partitions 58. Nozzles 58 can be connected at one end to outer wall 60 and at a second end to wall 62. Bridges 56 are connected at both ends within torus 54. Bridges 56 serve merely to mechanically maintain inner wall 62 and outer wall 60 in position against the outward stress of pressurized fluid, for example steam, exerted within chamber 64 during operation. Conventional design practice is that bridges 56 must be spaced far apart so as to not cause pressure loss within the system and serve the mechanical purpose intended for maintaining the structural integrity of inner wall 62 and outer wall 60.

In operation, a flow of steam, represented schematically by flow arrows 66, 68 and 70, under pressure is received in torus 54 though inlets 52 in the direction of flow arrows 66 and forced into chamber 64. By conventional pressure differential principles, the flow of steam is forced through chamber 64, through bridges 56, through nozzles 58 and through an outlet 72 in the direction of flow arrows 70, which flow arrows 70 are generally perpendicular to flow arrows 66. Steam flowing in direction 70 impacts and drives the turbine blades of the turbo machinery.

Figure 3:
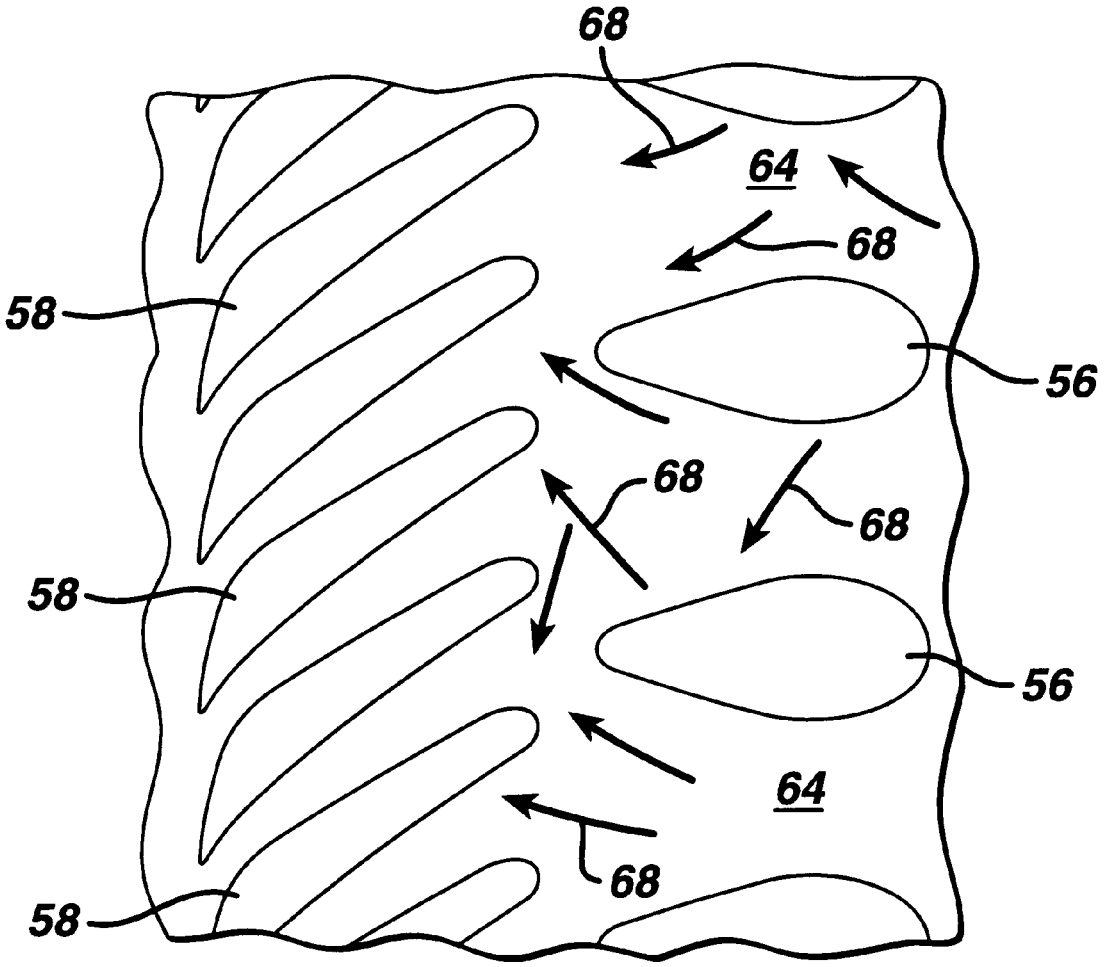
FIG. 3 is a schematic view of the nozzle box of FIG. 2 with a portion of the nozzle box enlarged and cut away to expose the configuration of a plurality of nozzles and a plurality of bridges located therein.

Still referring to FIGS. 2 and 3, experimentally and computationally, for example, using a conventional computational fluid dynamics code, such as CFX5.2 sold by AEA Technology, PLC headquartered in Great Britain, tests have determined that the efficiency of a high pressure section can be substantially increased if the uniformity of the flow of steam exiting nozzle box 50 is enhanced. As used herein, the phrase substantially increased means an increase in efficiency in the range between about 1% to about 2% above the 88% efficiency of a typical high pressure section of a steam turbine.

As determined in the manner discussed above, the configuration of nozzles 58 and bridges 56 in nozzle box 50 leads to significant circumferential non-uniformity characteristics in terms of a swirl angle and an axial velocity of the flow of steam passing through and out of nozzle box 50. At least in part, the swirl angle and axial velocity components are created by flowing the steam into and out of nozzle box 50, for example, the steam flowing into nozzle box 50 in a direction 66 but flowing out of nozzle box 50 in a direction 70 that is perpendicular to direction 66. Also, for example, multiple inlets 52, that enter chamber 64 from opposite directions, further contribute to creating the efficiency reducing non-uniformity characteristics.

As a result of these non-uniformity characteristics, it has been determined that the flow of steam leaving outlet 72 and impacting the turbo machinery, is not substantially circumferentially uniform. The energy provided by the flow of steam is a series of peaks and valleys over the circumference of outlet 72. Consequently, the turbo machinery runs less efficiently than possible with a circumferentially uniform flow of steam.

Still referring to FIGS. 2 and 3, another factor considered was the critical constraint of bridges 56 that carry the tensile stress between inner wall 62 and outer wall 60 to prevent structural failure, for example, blow out of nozzle box 50 at inner wall 62 or outer wall 60. Additionally, it is desirable to enhance the uniformity of the flow of steam without significantly increasing the total pressure loss or else any gain realized by uniformity will be canceled out by the loss of energy attributed to pressure loss.

Figure 4:
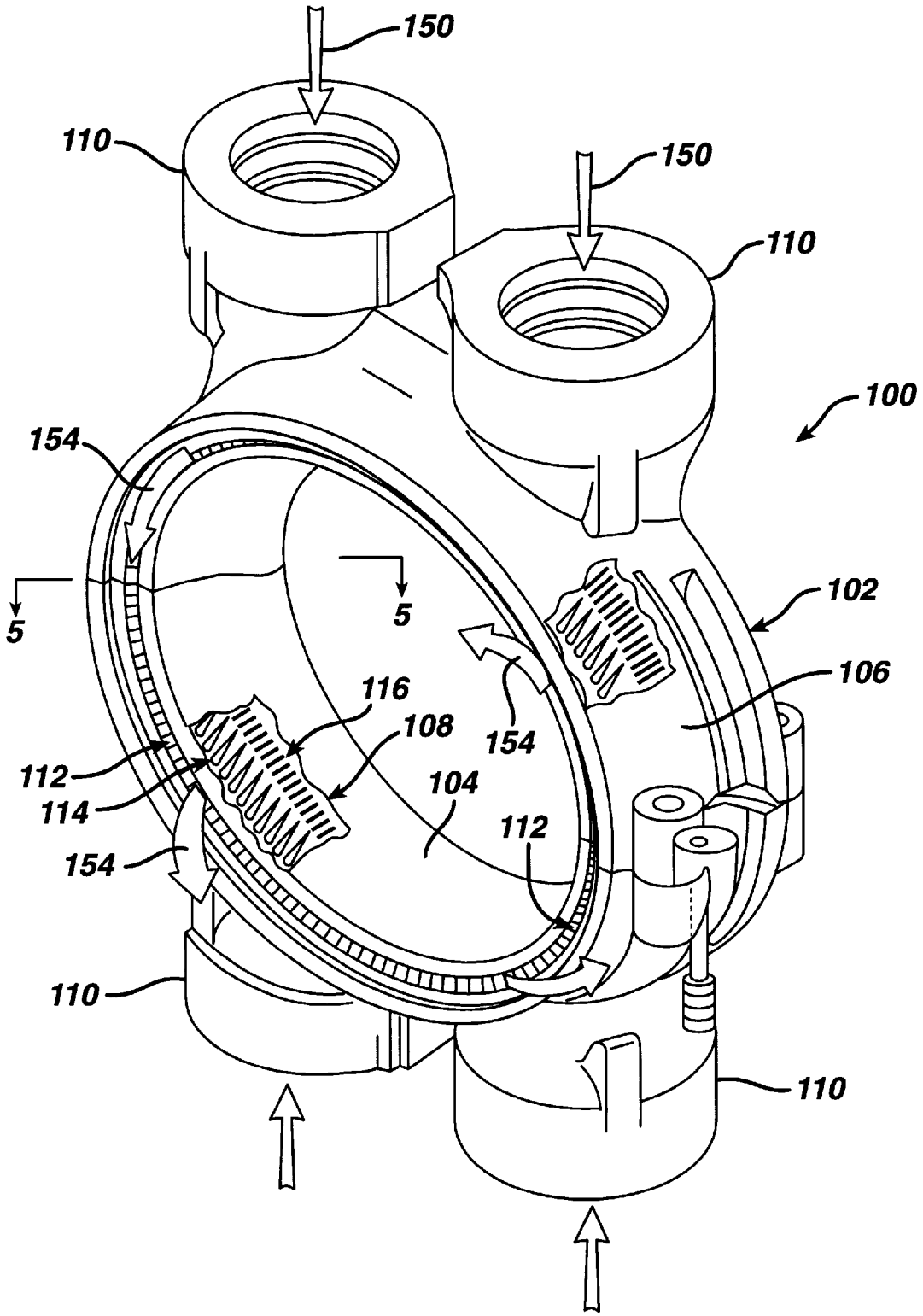
FIG. 4 is an enlarged perspective, partially cut-away view of an exemplary embodiment of a nozzle box of the invention.
Figure 5:
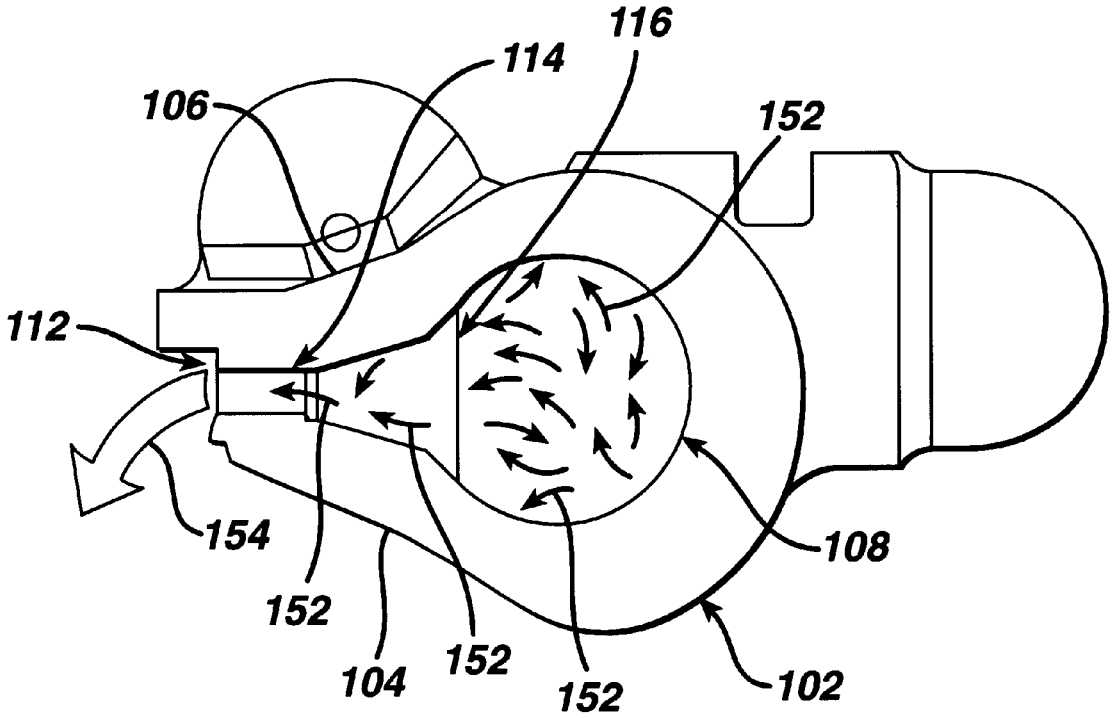
FIG. 5 is a cross-sectional view of the nozzle box of FIG. 4 taken along the line 5—5.

FIGS. 4–5 illustrate a nozzle box 100 mountable to encircle a shaft of a turbine (not shown) for directing a flow of fluid, for example, steam, to a turbine. Nozzle box 100 includes a housing 102 having an inner wall 104 spaced from an outer wall 106 and joined therewith so as to form a chamber 108. Housing 102 includes at least one inlet 110 and at least one outlet 112 in which each is in fluid flow communication with chamber 108. A plurality of radially projecting nozzles 114 are fixedly positioned between inner wall 104 and outer wall 106 and located upstream of outlet 112 for directing the flow of fluid through outlet 112. A flow distributor 116 is fixedly positioned between inner wall 104 and outer wall 106 and located upstream of nozzles 114 for directing the flow of fluid through chamber 108 to nozzles 114. Flow distributor 116 is typically rigidly connected to both inner wall 104 and outer wall 106. Nozzle box 100 and associated components are constructed of typical materials used to make similar components in nozzle box 50 (FIG. 2). Flow distributor 116 is constructed of typical materials used for structural bridges 56 (FIG. 2).

FIGS. 4 and 5 further illustrate nozzle box 100 as a single-flow nozzle box. Double-flow nozzle boxes can implement the invention and would generally be constructed and function similar to the single-flow box as shown and described. In particular, a double-flow nozzle box (not shown) also directs a flow of steam out the "back" of housing 102, in a direction generally 180° opposite that of outlet 112. Such a nozzle box would thus have a second flow distributor and a second ring of nozzles included therein for directing a second flow of steam to the turbo machinery.

Generally, FIGS. 6–9A, illustrate flow distributor 116 configured to obtain a substantially uniform flow of fluid, for example, steam, to nozzles 114. Flow distributor 116 smooths out or reduces a circumferential variation of the flow velocity and straightens or reduces the swirl angle of the flow, thereby enhancing the uniformity of the flow of fluid exiting nozzle box 100, without significantly increasing total pressure loss of the flow of fluid. For example, flow distributor 116 includes a plurality of flow members 118. Each flow member 118 is at least partially spaced from an adjacent flow member 118 by a flow passage 120 formed therebetween. Flow passage 120 may be defined by at least a pair of spaced side walls 122 positioned axially relative to an axis of a shaft and extending parallel relative to each other for at least an upstream portion 124 of flow passage 120. Flow passage 120 may have an axial length to width ratio greater than about 3.5:1.7, for example at the narrowest portion of flow passage 120, and preferably has such a ratio of about 3.5:0.4.

Figure 6:
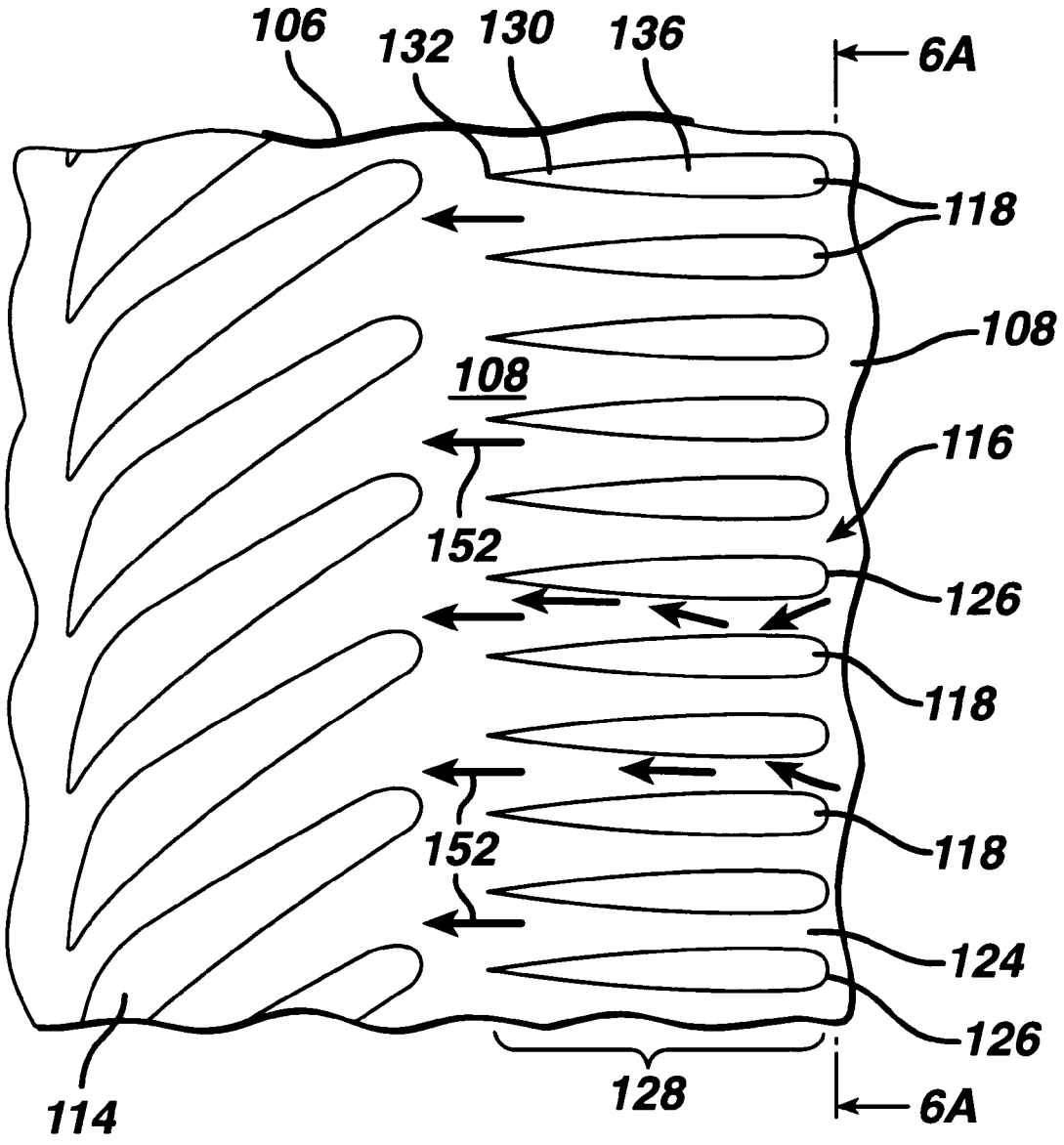
FIG. 6 is an enlarged schematic view of a cut-away portion of the nozzle box of FIG. 4 detailing a flow distributor and a plurality of radially projecting nozzles.
Figure 6A:
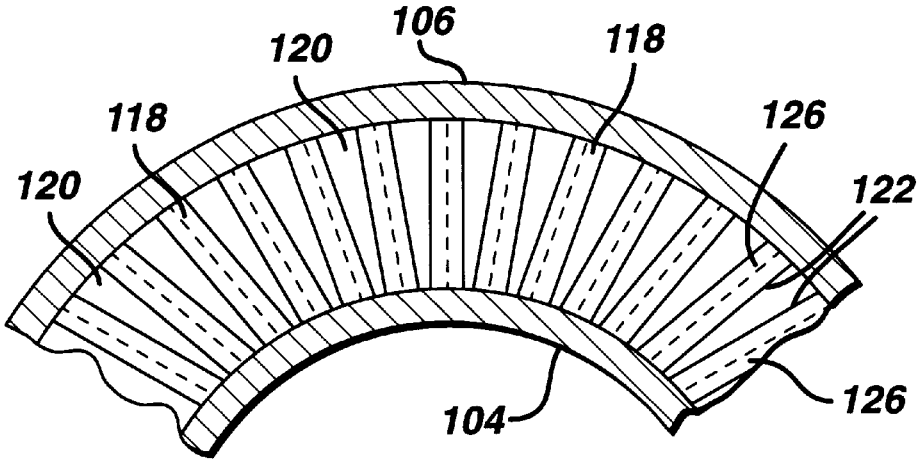
FIG. 6A is a back view of the flow distributor of FIG. 6 taken along the line 6A—6A without the cut-away portion removed.

FIGS. 6 and 6A illustrate an exemplary embodiment including flow members 118 having an aerodynamically shaped nose 126 upstream of spaced side walls 122. Also, along a length 128 of flow member 118, flow member 118 has a thickness no greater than a greatest thickness of aerodynamically shaped nose 126. Flow members 118 may also have an aerodynamically shaped tail 130 downstream of side walls 122. Tail 130 may taper to a single edge 132. An alternative way of defining the configuration of flow members 118 and flow passages 120 relative to nozzles 114, for example, is where each nozzle 114 has at least one flow member 118, and preferably two, corresponding thereto and located adjacent to and upstream thereof.

Figure 7A:
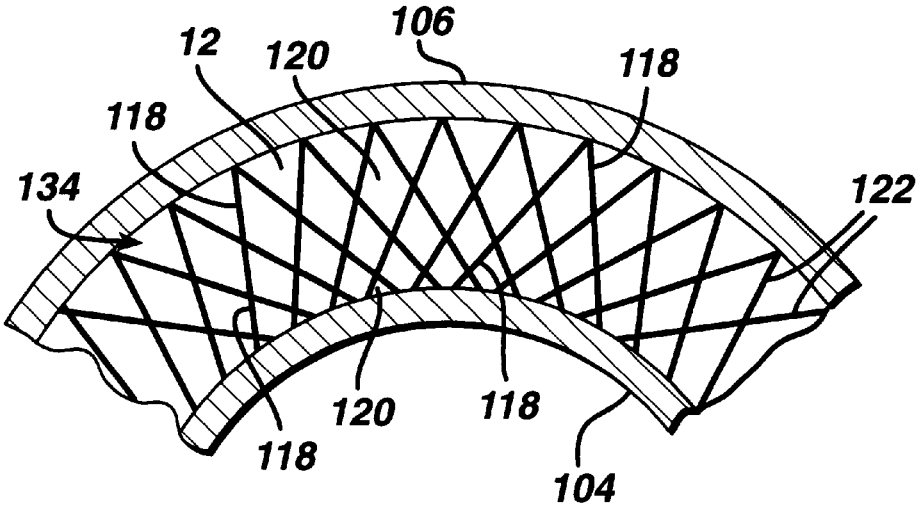
FIG. 7A is a back view of the flow distributor of FIG. 7 taken along the line 7A—7A without the cut-away portion removed.
Figure 7:
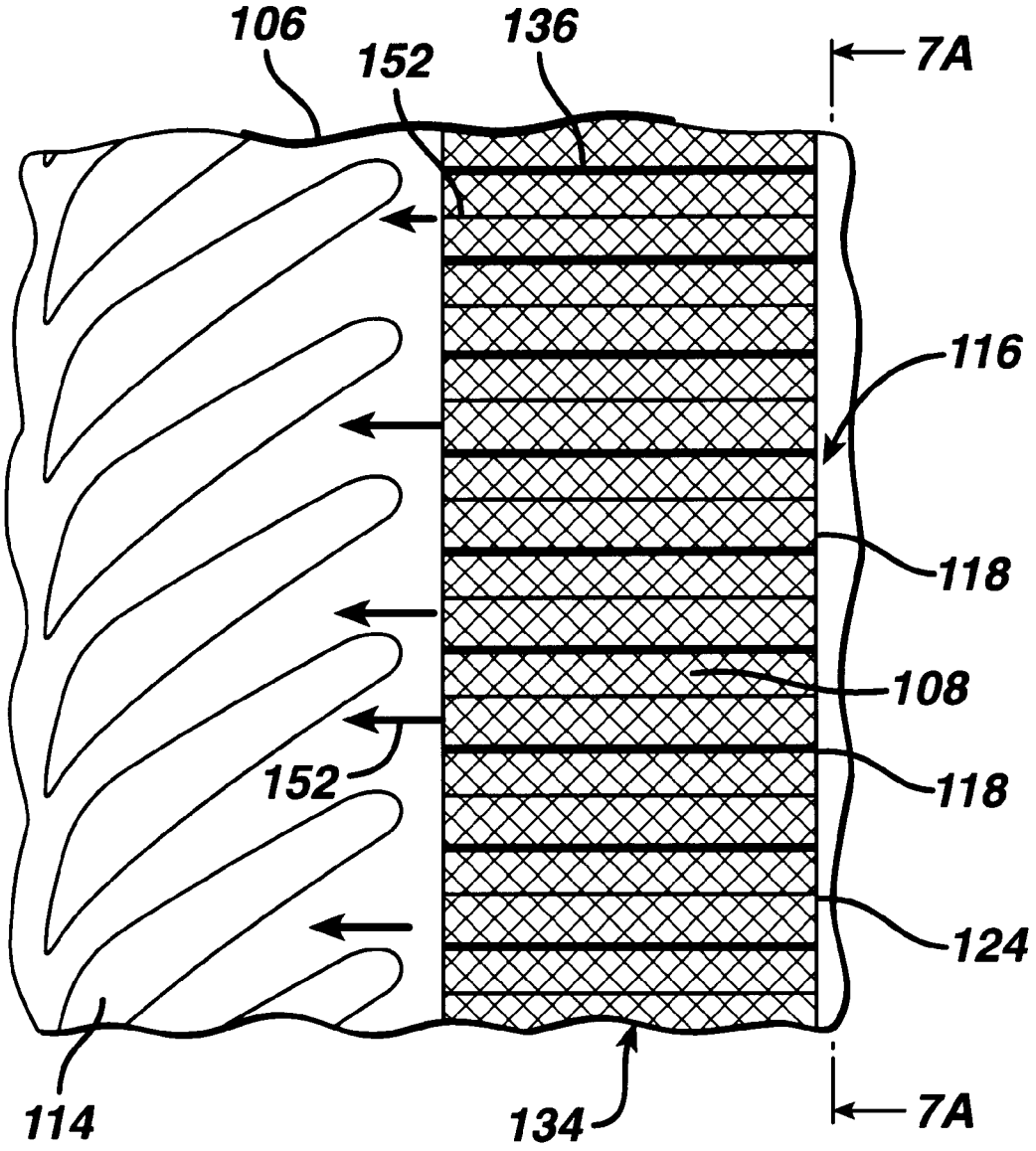
FIG. 7 is a view similar to FIG. 6 but of an alternative embodiment of the flow distributor comprising a honeycomb structure.

FIGS. 7 and 7A illustrate an alternative embodiment of flow distributor 116 comprising a honeycomb structure 134. In this embodiment, as well as that illustrated in FIGS. 6 and 6A, flow members 118 may also define a plurality of bridge struts 136, similar to structural bridges 56 (FIG. 2). Accordingly, flow members 118 of FIGS. 6–7A, are connected at opposite ends to inner wall 104 and outer wall 106 to provide the mechanical strength necessary to avoid blow out of nozzle box 100 during use.

Figure 8:
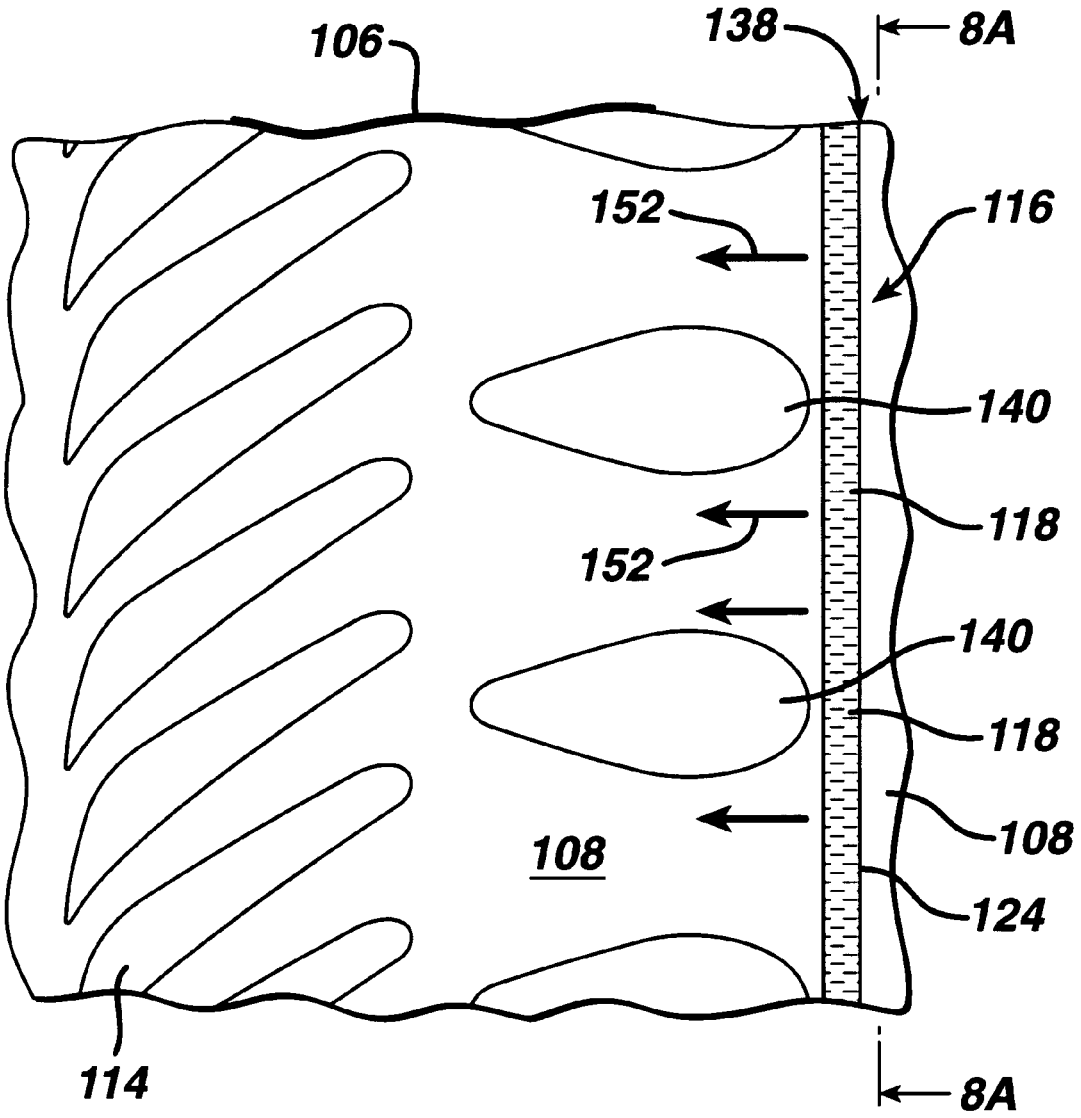
FIG. 8 is a view similar to FIG. 6 but of an alternative embodiment of the flow distributor comprising a holed plate.
Figure 8A:
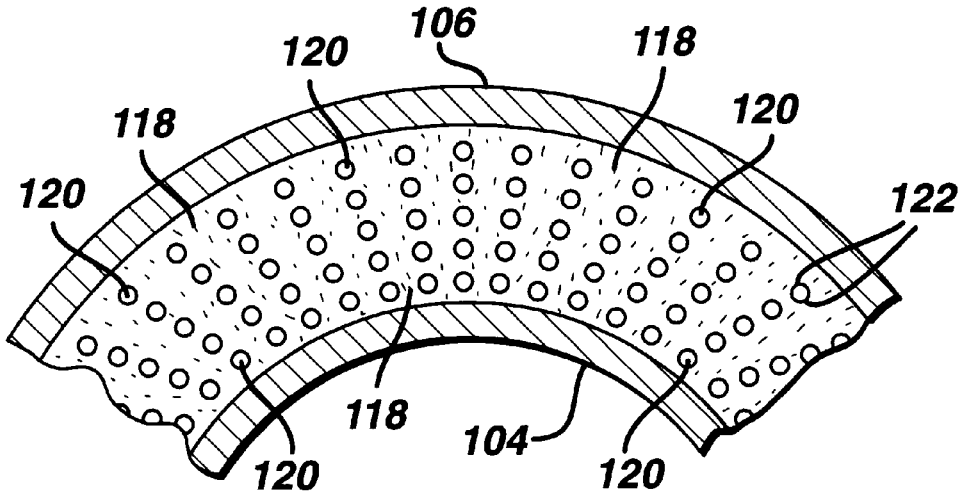
FIG. 8A is a back view of the flow distributor of FIG. 8 taken along the line 8A—8A without the cut-away portion removed.
Figure 9A:
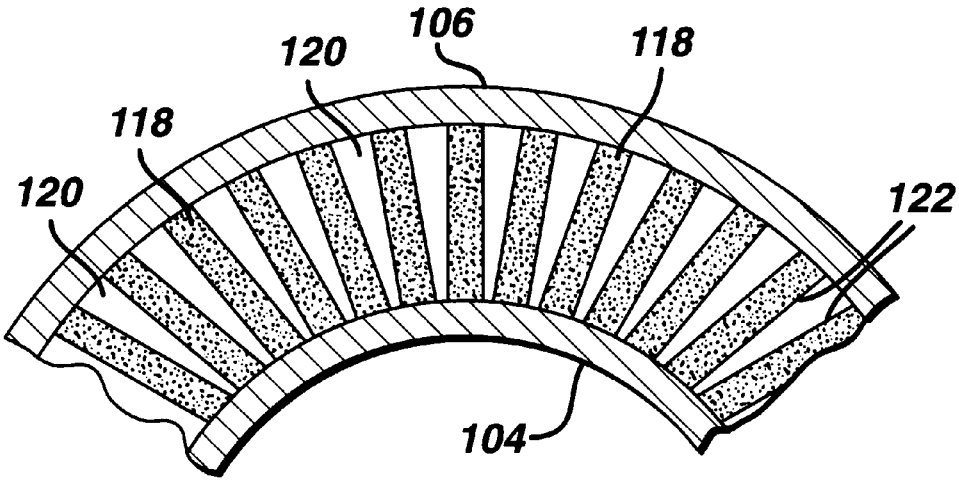
FIG. 9A is a back view of the flow distributor of FIG. 9 taken along the line 9A—9A without the cut-away portion removed.
Figure 9:
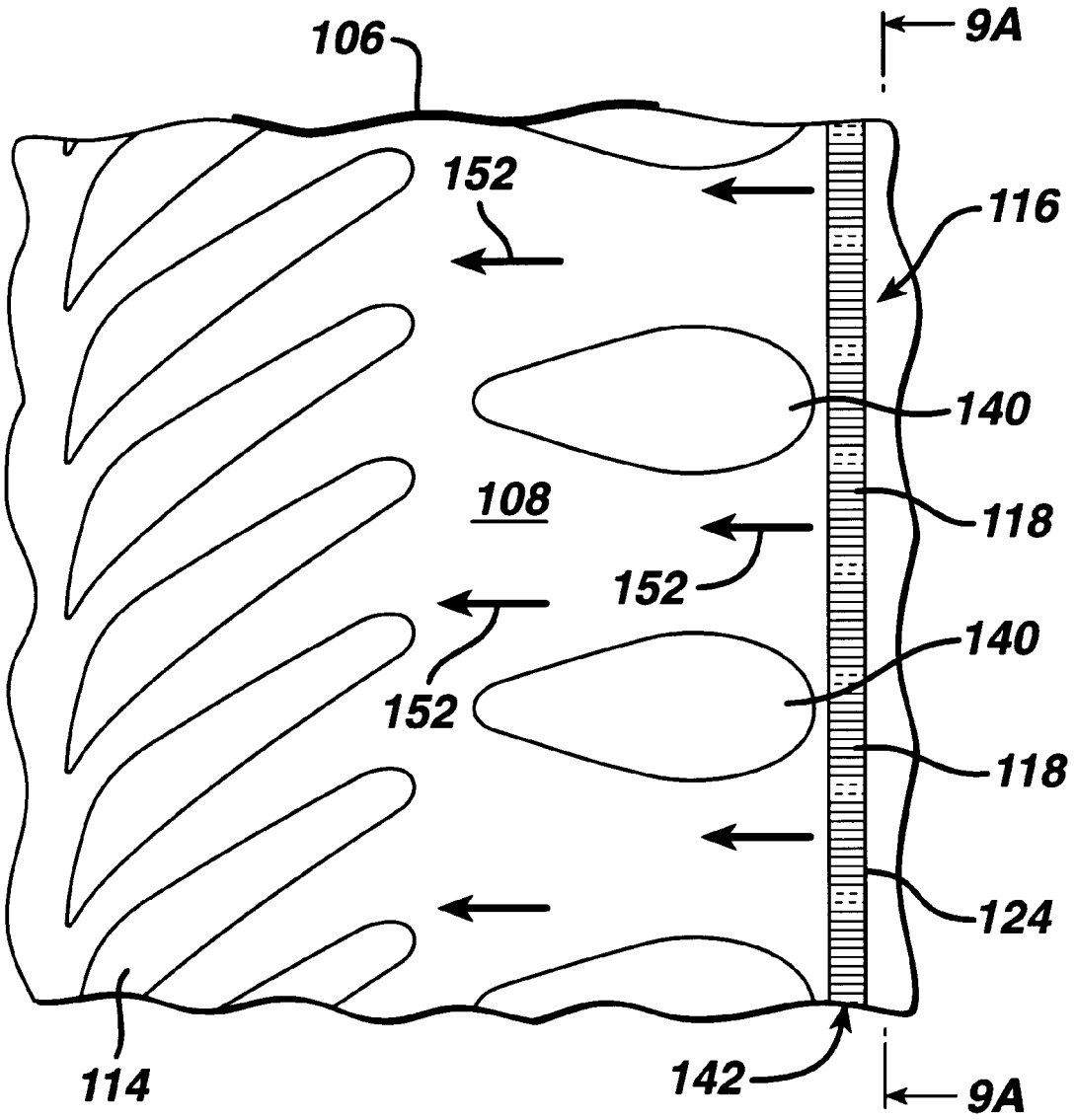
FIG. 9 is a view similar to FIG. 6 but of an alternative embodiment of the flow distributor comprising a slotted plate.

FIGS. 8 and 8A illustrate another embodiment of flow distributor 116 comprising a holed plate 138. Holed plate 138 is positioned between inner wall 104 and outer wall 106, fixed to both or either wall, upstream of a plurality of bridge struts 140. Bridge struts 140 are fixedly connected between the inner and outer walls and provide the mechanical strength necessary to avoid blow out of nozzle box 100 during use. FIGS. 9 and 9A, illustrate yet another embodiment of flow distributor 116 comprising a slotted plate 142. Slotted plate 142 is similar in all respects, other than its obvious configuration difference, to holed plate 138. It should also be understood that the invention includes plates 138 and 142 located downstream of bridge struts 140, although this configuration is not illustrated.

Figure 10:
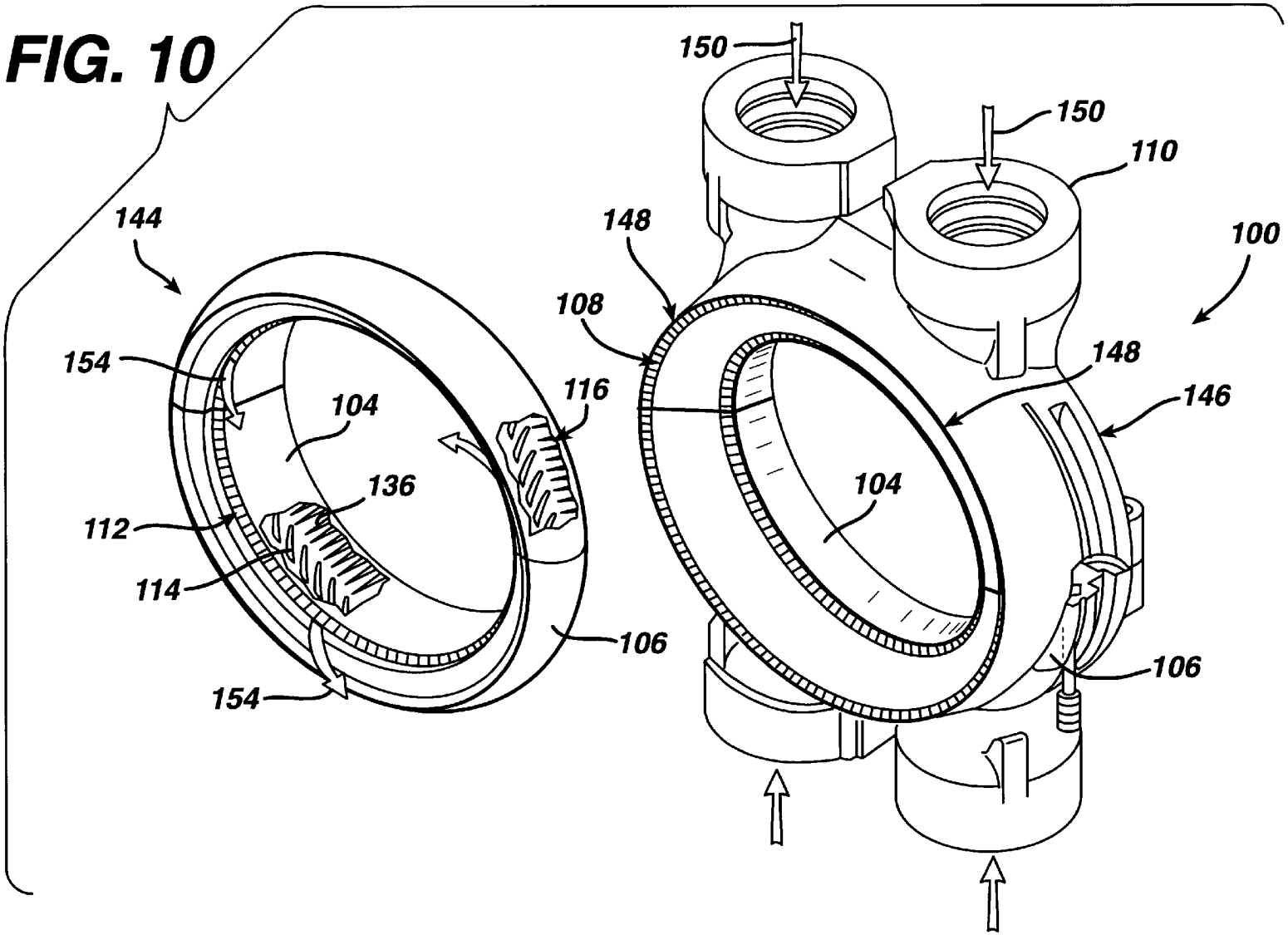
FIG. 10 is an exploded view of a nozzle box similar to FIG. 5 but of an alternative embodiment of the flow distributor comprising a retro-fit part separably connectable with the nozzle box and having a flow distributor configuration similar to FIG. 6.

FIG. 10 illustrates an alternative embodiment of flow distributor 116 comprising a retro-fit flow distributor unit 144. Unit 144 is separably connectable with nozzle box 100 and has a flow distributor 116 configuration similar to FIG. 6. Unit 144, however, could have any flow distributor configuration discussed above. Housing 146 is similar to that of FIG. 4 except that housing 146 has an annular outlet 148 to which unit 144 is connectable. For example, housing 146 can be formed from a typical nozzle box 50 (FIG. 2) when torus 54 is altered by cutting or grinding a portion up to and including nozzles 58 and structural bridges 56. Then, unit 144 can be welded or otherwise fixedly connected to torus 54. In all other respects, the embodiment of FIG. 10 is structurally and functionally similar to those embodiments discussed herein.

Nozzle box 100 and flow distributor 116 of FIGS. 4–10, inclusive, operate as follows, for example. A flow of fluid, for example, steam, represented generally by flow arrows 150, 152 and 154, under pressure is received in housings 102, 146 though inlets 110 in the direction of flow arrows 150 and forced into chamber 108. By pressure differential principles, the flow of steam is directed through chamber 108, through flow distributor 116, through nozzles 114 and through outlet 112 in the direction of flow arrows 154, which flow arrows 154 are generally perpendicular to flow arrows 150. As the flow is directed through flow distributor 116, for example, a swirl angle of the flow is reduced and a circumferential variation of the flow is reduced to cause a substantially uniform flow of fluid to pass through nozzles 114. The substantially uniform flow may be created before or after directing the flow of fluid through bridge struts 136 and 140. The substantially uniform flow of fluid is then directed by nozzles 114 through outlet 112 and to, for example, turbo machinery.

As various possible embodiments may be made in the above invention for use for different purposes and as various changes might be made in the embodiments above set forth, it is understood that all matters here set forth or shown in the accompanying drawings are to be interpreted as illustrative and not in a limiting sense.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A nozzle box mountable to encircle a shaft for directing a flow of fluid to a turbine, comprising:

a housing having an inner wall spaced from an outer wall and joined therewith so as to form a chamber therein, said housing including at least one inlet and at least one outlet in which each is in fluid flow communication with said chamber;

a plurality of radially projecting nozzles positioned between said inner and said outer walls and located upstream of said outlet;

a flow distributor positioned between said inner and said outer walls and located upstream of the nozzles for directing the flow of fluid through said chamber, said flow distributor being configured to obtain a substantially uniform flow of fluid and direct said flow to said nozzles, and wherein said nozzles then direct the substantially uniform flow of fluid through said outlet, said flow distributor comprising a slotted plate; and a holed plate or a honeycomb structure.

2. The nozzle box of claim 1, in which said flow distributor includes a plurality of flow members with each flow member being at least partially spaced from an adjacent flow member by a flow passage formed therebetween and said flow passage being defined by at least a pair of spaced side walls positioned axially relative to an axis of said shaft and extending parallel relative to each other for at least an upstream portion of each flow passage.

3. T he nozzle box of claim 2, in which said flow passage has an axial length to width ratio greater than about 3.5:1.7.

4. The nozzle box of claim 3, in which each of said plurality of flow members has an aerodynamically shaped nose upstream of said pair of spaced side walls, and along a length of said flow member said flow member has a thickness no greater than a greatest thickness of said aerodynamically shaped nose.

5. The nozzle box of claim 4, in which each of said plurality of flow members has an aerodynamically shaped tail downstream of said pair of spaced side walls and said aerodynamically shaped tail tapers to a single edge.

6. The nozzle box of claim 2, in which each of the plurality of nozzles has at least one of said plurality of flow members corresponding thereto and located adjacent to and upstream of each nozzle.

7. The nozzle box of claim 6, in which each of said plurality of nozzles has two of said plurality of flow members corresponding thereto and located adjacent to and upstream of each nozzle.

8. The nozzle box of claim 2, further comprising a plurality of bridge struts connected between said inner and said outer walls and located upstream of said nozzles and downstream of said flow distributor.

9. The nozzle box of claim 2, in which said plurality of flow members further define a plurality of bridge struts connected between said inner and said outer walls.

10. A flow distributor unit for use in a nozzle box mountable to encircle a shaft for directing a flow of fluid to a turbine, said nozzle box including an inlet and an annular outlet, said flow distributor unit comprising:

a housing having an inner wall spaced from an outer wall and joined therewith where said housing is connectable with said nozzle box adjacent said annular outlet in which a chamber is formed by said inner and said outer walls and said nozzle box and in which said housing has an outlet;

a plurality of radially projecting nozzles positioned between said inner and said outer walls and located upstream of said outlet;

a flow distributor positioned between said inner and said outer walls and located upstream of said nozzles for directing said flow of fluid through said chamber, said flow distributor being configured to obtain and direct a substantially uniform flow of fluid to said nozzles, wherein said nozzles then direct the substantially uniform flow of fluid through said outlet; and said flow distributor comprising a slotted plate, a holed slate or a honeycomb structure.

11. A method for retro-fitting a nozzle box which directs a flow of fluid to a turbine, said nozzle box including an inlet and an outlet adjacent a plurality of radially projecting nozzles located between an inner wall spaced from an outer wall, comprising:

removing said nozzles and a portion of said inner and said outer walls adjacent said nozzles to form an annular outlet of the nozzle box;

joining a flow distributor adjacent said annular outlet; and locating a second plurality of radially projecting nozzles downstream of said flow distributor, wherein said flow distributor is configured to direct a substantially uniform flow of fluid to said nozzles;

wherein said nozzle box further includes a plurality of structural bridges upstream of said nozzles and connected between said inner and said outer walls and said removing includes said structural bridges and a portion of said inner and said outer walls adjacent said structural bridges.

12. The method of claim 11, in which said nozzle box further includes a plurality of structural bridges upstream of said nozzles and connected between said inner and said outer walls and said removing includes said structural bridges and a portion of said inner and said outer walls adjacent said structural bridges.

13. The method of claim 11, in which the second plurality of radially projecting nozzles and said flow distributor are integrally formed as a flow distributor unit.

* * * * *

UNITED STATES PATENT AND TRADEMARK OFFICE

CERTIFICATE OF CORRECTION

PATENT NO. : 6,196,793 B1
DATED : March 6, 2001
INVENTOR(S) : Mark Edward Braaten It is certified that error appears in the above-identified patent and that said Letters Patent is hereby corrected as shown below:

Column 5, claim 1,
Line 38-56 should read:

1. A nozzle box mountable to encircle a shaft for directing a flow of fluid to a turbine, comprising:

a housing having an inner wall spaced from an outer wall and joined therewith so as to form a chamber therein, said housing including at least one inlet and at least one outlet in which each is in fluid flow communication with said chamber;

a plurality of radially projecting nozzles positioned between said inner and said outer walls and located upstream of said outlet; and a flow distributor positioned between said inner and said outer walls and located upstream of the nozzles for directing the flow of fluid through said chamber, said flow distributor being configured to obtain a substantially uniform flow of fluid and direct said flow to said nozzles, and wherein said nozzles then direct the substantially uniform flow of fluid through said outlet, said flow distributor comprising a slotted plate[; and] a holed plate or a honeycomb structure.

Signed and Sealed this

Thirteenth day of November, 2001

*Attest:*

Nicholas P. Godici

NICHOLAS P. GODICI
*Acting Director of the United States Patent and Trademark Office*

*Attesting Officer*